US007624808B2

(12) United States Patent
Mock

(10) Patent No.: US 7,624,808 B2
(45) Date of Patent: Dec. 1, 2009

(54) EXPANDABLE RAMP GRIPPER

(75) Inventor: Phillip W. Mock, Costa Mesa, CA (US)

(73) Assignee: Western Well Tool, Inc., Anaheim, CA (US)

( * ) Notice: Subject to any disclaimer, the term of this patent is extended or adjusted under 35 U.S.C. 154(b) by 174 days.

(21) Appl. No.: 11/683,959

(22) Filed: Mar. 8, 2007

(65) Prior Publication Data

US 2007/0209806 A1 Sep. 13, 2007

Related U.S. Application Data

(60) Provisional application No. 60/781,885, filed on Mar. 13, 2006, provisional application No. 60/876,738, filed on Dec. 22, 2006.

(51) Int. Cl.
*E21B 23/00* (2006.01)
*E21B 23/04* (2006.01)

(52) U.S. Cl. ..... 166/382; 166/212; 166/217; 175/99; 175/230

(58) Field of Classification Search ..... 166/212, 166/217, 382; 175/99, 230
See application file for complete search history.

(56) References Cited

U.S. PATENT DOCUMENTS

| | | | |
|---|---|---|---|
| 2,167,194 | A | 7/1939 | Anderson |
| 2,271,005 | A | 1/1942 | Grebe |
| 2,569,457 | A | 10/1951 | Dale et al. |
| 2,727,722 | A | 12/1955 | Conboy |
| 2,946,565 | A | 7/1960 | Williams |
| 2,946,578 | A | 7/1960 | De Smaele |
| 3,138,214 | A | 6/1964 | Bridwell |
| 3,180,436 | A | 4/1965 | Kellner et al. |
| 3,180,437 | A | 4/1965 | Kellner et al. |
| 3,185,225 | A | 5/1965 | Ginies |
| 3,224,513 | A | 12/1965 | Weeden, Jr. |
| 3,224,734 | A | 12/1965 | Hill |

(Continued)

FOREIGN PATENT DOCUMENTS

| | | |
|---|---|---|
| DE | 2439063 | 2/1976 |

(Continued)

OTHER PUBLICATIONS

"Kilobomac to Challenge Tradition" Norwegian Oil Review, 1988, pp. 50-52.

(Continued)

*Primary Examiner*—Jennifer H Gay
*Assistant Examiner*—Cathleen R Hutchins
(74) *Attorney, Agent, or Firm*—Knobbe, Martens, Olson & Bear, LLP

(57) ABSTRACT

A gripper for use in a downhole tool is provided. The gripper can include an actuator, a toe assembly, and an expandable assembly. The toe assembly can be a leaf-spring like elongate continuous beam. The expandable assembly can be a linkage including a plurality of links. The linkage is coupled to the actuator such that the actuator expands the expandable assembly which in turn expands the toe assembly. In operation, during one stage of expansion radial forces are transmitted to the toe through both interaction of a rolling mechanism on the toe with the expandable assembly and pressure of the linkage assembly directly on an inner surface of the toe.

27 Claims, 10 Drawing Sheets

U.S. PATENT DOCUMENTS 3,225,843 A 12/1965 Ortloff et al.
3,376,942 A 4/1968 Van Winkle
3,497,019 A 2/1970 Ortloff
3,599,712 A 8/1971 Magill
3,606,924 A 9/1971 Malone
3,661,205 A 5/1972 Belorgey
3,664,416 A 5/1972 Nicolas et al.
3,797,589 A 3/1974 Kellner et al.
3,827,512 A 8/1974 Edmond
RE28,449 E 6/1975 Edmond
3,941,190 A 3/1976 Conover
3,978,930 A 9/1976 Schroeder
3,992,565 A 11/1976 Gatfield
4,040,494 A 8/1977 Kellner
4,085,808 A 4/1978 Kling
4,095,655 A 6/1978 Still
4,141,414 A 2/1979 Johansson
4,314,615 A 2/1982 Sodder, Jr. et al.
4,365,676 A 12/1982 Boyadjieff et al.
4,372,161 A 2/1983 de Buda et al.
4,385,021 A 5/1983 Neeley
4,440,239 A 4/1984 Evans
4,463,814 A 8/1984 Horstmeyer et al.
4,558,751 A 12/1985 Huffaker
4,573,537 A 3/1986 Hirasuna et al.
4,615,401 A 10/1986 Garrett
4,674,914 A 6/1987 Wayman et al.
4,686,653 A 8/1987 Staron et al.
4,811,785 A 3/1989 Weber
4,821,817 A 4/1989 Cendre et al.
4,854,397 A 8/1989 Warren et al.
4,951,760 A 8/1990 Cendre et al.
5,010,965 A 4/1991 Schmelzer
5,052,211 A 10/1991 Cohrs et al.
5,090,259 A 2/1992 Shishido et al.
5,169,264 A 12/1992 Kimura
5,184,676 A 2/1993 Graham et al.
5,186,264 A 2/1993 du Chaffaut
5,310,012 A 5/1994 Cendre et al.
5,363,929 A 11/1994 Williams et al.
5,419,405 A 5/1995 Patton
5,425,429 A 6/1995 Thompson
5,449,047 A 9/1995 Schivley, Jr.
5,467,832 A 11/1995 Orban et al.
5,519,668 A 5/1996 Montaron
5,542,253 A 8/1996 Ganzel
5,613,568 A 3/1997 Sterner et al.
5,752,572 A 5/1998 Baiden et al.
5,758,731 A 6/1998 Zollinger
5,758,732 A 6/1998 Liw
5,765,640 A 6/1998 Milne et al.
5,794,703 A 8/1998 Newman et al.
5,803,193 A 9/1998 Krueger et al.
5,845,796 A 12/1998 Miller
5,857,731 A 1/1999 Heim et al.
5,947,213 A 9/1999 Angle et al.
5,954,131 A 9/1999 Sallwasser
5,960,895 A 10/1999 Chevallier et al.
5,996,979 A 12/1999 Hrusch
6,003,606 A 12/1999 Moore et al.
6,026,911 A 2/2000 Angle et al.
6,031,371 A 2/2000 Smart
6,089,323 A 7/2000 Newman et al.
6,112,809 A 9/2000 Angle
6,230,813 B1 5/2001 Moore et al.
6,241,031 B1 6/2001 Beaufort et al.
6,273,189 B1 8/2001 Gissler et al.
6,286,592 B1 9/2001 Moore et al.
6,345,669 B1 2/2002 Buyers et al.
6,347,674 B1 2/2002 Bloom et al.
6,378,627 B1 4/2002 Tubel et al.
6,427,786 B2 8/2002 Beaufort et al.
6,431,270 B1 8/2002 Angle
6,431,291 B1 8/2002 Moore et al.
6,464,003 B2 10/2002 Bloom et al.
6,478,097 B2 11/2002 Bloom et al.
6,601,652 B1 8/2003 Moore et al.
6,629,568 B2 10/2003 Post et al.
6,640,894 B2 11/2003 Bloom et al.
6,679,341 B2 1/2004 Bloom et al.
6,715,559 B2 4/2004 Bloom et al.
6,745,854 B2 6/2004 Bloom et al.
6,758,279 B2 7/2004 Moore et al.
6,910,533 B2 6/2005 Guerrero
6,920,936 B2 7/2005 Sheiretov et al.
6,938,708 B2 9/2005 Bloom et al.
6,953,086 B2 10/2005 Simpson
7,048,047 B2 5/2006 Bloom et al.
7,059,417 B2 6/2006 Moore et al.
7,080,700 B2 7/2006 Bloom et al.
7,080,701 B2 7/2006 Bloom et al.
7,121,364 B2 10/2006 Mock et al.
7,174,974 B2 2/2007 Bloom et al.
7,185,716 B2 3/2007 Bloom et al.
7,188,681 B2 3/2007 Bloom et al.
7,191,829 B2 3/2007 Bloom et al.
7,275,593 B2 10/2007 Bloom et al.
7,343,982 B2 3/2008 Mock et al.
7,353,886 B2 4/2008 Bloom et al.
7,392,859 B2 7/2008 Mock et al.
7,493,967 B2 2/2009 Mock et al.
2001/0045300 A1 11/2001 Fincher et al.
2002/0032126 A1 3/2002 Kusmer
2002/0079107 A1 6/2002 Simpson
2002/0088648 A1 7/2002 Krueger et al.
2002/0112859 A1 8/2002 Bloom et al.
2003/0024710 A1* 2/2003 Post et al. ..... 166/382
2003/0116356 A1 6/2003 Bloom et al.
2003/0150609 A1 8/2003 Stoesz
2003/0183383 A1* 10/2003 Guerrero ..... 166/206
2004/0168828 A1 9/2004 Mock et al.
2005/0034874 A1 2/2005 Guerrero et al.
2005/0082055 A1 4/2005 Bloom et al.
2005/0146416 A1 7/2005 Doerling et al.
2005/0217861 A1 10/2005 Misselbrook
2005/0247488 A1 11/2005 Mock et al.
2006/0108151 A1 5/2006 Moore et al.
2006/0180318 A1 8/2006 Doering et al.
2006/0201716 A1 9/2006 Bloom et al.
2007/0181298 A1* 8/2007 Sheiretov et al. ..... 166/212

FOREIGN PATENT DOCUMENTS

DE 2920049 2/1981
EP 0 149 528 A1 7/1985
EP 0 951 611 B1 1/1993
EP 0 257 744 B1 1/1995
EP 0 767 289 A1 4/1997
EP 1 281 834 A 2/2003
EP 1344893 A2 9/2003
EP 1 350 917 3/2008
GB 894117 4/1962
GB 1105701 3/1968
GB 2 241 723 A 9/1991
GB 2 305 407 4/1997
GB 2 310 871 A 9/1997
GB 2 346 908 A 8/2000
WO WO 89/05391 6/1989
WO WO 92/13226 8/1992
WO WO 93/18277 9/1993
WO WO 94/27022 11/1994
WO WO 95/21987 8/1995
WO WO 00/36266 6/2000
WO WO 00/46461 8/2000

| | | | |
|---|---|---|---|
| WO | WO 02/44509 | A2 | 6/2002 |
| WO | WO 2008/104177 | | 9/2008 |
| WO | WO 2008/104178 | | 9/2008 |
| WO | WO 2008/104179 | | 9/2008 |

OTHER PUBLICATIONS

UK Search Report dated May 25, 2007 for Application GB0704656.8.

PCT International Search Report and Written Opinion of the ISA dated Jun. 16, 2005 for International Application No. PCT/US2005/008919.

PCT International Search Report and Written Opinion of the ISA dated Apr. 22, 2008 for International Application No. PCT/US2007/084574.

U.S. Appl. No. 11/865,676, filed Oct. 1, 2007, titled Gripper Assembly for Downhole Tools.

U.S. Appl. No. 12/046,283, filed Mar. 11, 2008, titled Tractor With Improved Valve System.

U.S. Appl. No. 12/165,210, filed Jun. 30, 2008, titled Roller Link toggle Gripper And Downhole Tractor.

U.S. Appl. No. 11/939,375, filed Nov. 13, 2007, titled Variable Linkage Assisted Gripper.

U.S. Appl. No. 12/139,385, filed Jun. 13, 2008, titled Electrically Powered Tractor.

U.S. Appl. No. 12/368,417, filed Feb. 10, 2009, titled Tractor With Improved Valve System.

* cited by examiner

EXPANDABLE RAMP GRIPPER

CROSS-REFERENCE TO RELATED APPLICATIONS

This application claims the benefit of U.S. Provisional Patent Application No. 60/781,885, entitled "EXPANDABLE RAMP GRIPPER," filed on Mar. 13, 2006 and U.S. Provisional Patent Application No. 60/876,738, entitled "EXPANDABLE RAMP GRIPPER," filed on Dec. 22, 2006.

Also, this application hereby incorporates by reference the above-identified provisional applications, in their entireties.

BACKGROUND OF THE INVENTION

1. Field of the Invention

This application relates generally to gripping mechanisms for downhole tools.

2. Description of the Related Art

Tractors for moving within underground boreholes are used for a variety of purposes, such as oil drilling, mining, laying communication lines, and many other purposes. In the petroleum industry, for example, a typical oil well comprises a vertical borehole that is drilled by a rotary drill bit attached to the end of a drill string. The drill string may be constructed of a series of connected links of drill pipe that extend between ground surface equipment and the aft end of the tractor. Alternatively, the drill string may comprise flexible tubing or "coiled tubing" connected to the aft end of the tractor. A drilling fluid, such as drilling mud, is pumped from the ground surface equipment through an interior flow channel of the drill string and through the tractor to the drill bit. The drilling fluid is used to cool and lubricate the bit, and to remove debris and rock chips from the borehole, which are created by the drilling process. The drilling fluid returns to the surface, carrying the cuttings and debris, through the annular space between the outer surface of the drill pipe and the inner surface of the borehole.

Tractors for moving within downhole passages are often required to operate in harsh environments and limited space. For example, tractors used for oil drilling may encounter hydrostatic pressures as high as 16,000 psi and temperatures as high as 300° F. Typical boreholes for oil drilling are 3.5-27.5 inches in diameter. Further, to permit turning, the tractor length should be limited. Also, tractors must often have the capability to generate and exert substantial force against a formation. For example, operations such as drilling require thrust forces as high as 30,000 pounds.

Western Well Tool, Incorporated has developed a variety of downhole tractors for drilling, completion and intervention processes for wells and boreholes. For example, the Puller-Thruster tractor is a multi-purpose tractor (U.S. Pat. Nos. 6,003,606, 6,286,592, and 6,601,652) that can be used in rotary, coiled tubing and wireline operations. A method of moving is described in U.S. Pat. No. 6,230,813. The Electro-hydraulically Controlled tractor (U.S. Pat. Nos. 6,241,031 and 6,427,786) defines a tractor that utilizes both electrical and hydraulic control methods. The Electrically Sequenced tractor (U.S. Pat. No. 6,347,674) defines a sophisticated electrically controlled tractor. The Intervention tractor (also called the tractor with improved valve system, U.S. Pat. No. 6,679,341 and U.S. Patent Application Publication No. 2004/0168828) is preferably an all hydraulic tractor intended for use with coiled tubing that provides locomotion downhole to deliver heavy loads such as perforation guns and sand washing. All of these patents and patent applications are incorporated herein by reference in their entirities.

These various tractors can provide locomotion to pull or push various types of loads. For each of these various types of tractors, various types of gripper elements have been developed. Thus one important part of the downhole tractor tool is its gripper system.

In one known design, a tractor comprises an elongated body, a propulsion system for applying thrust to the body, and grippers for anchoring the tractor to the inner surface of a borehole or passage while such thrust is applied to the body. Each gripper has an actuated position in which the gripper substantially prevents relative movement between the gripper and the inner surface of the passage, and a retracted position in which the gripper permits substantially free relative movement between the gripper and the inner surface of the passage. Typically, each gripper is slidingly engaged with the tractor body so that the body can be thrust longitudinally while the gripper is actuated. The grippers preferably do not substantially impede "flow-by," the flow of fluid returning from the drill bit up to the ground surface through the annulus between the tractor and the borehole surface.

Tractors may have at least two grippers that alternately actuate and reset to assist the motion of the tractor. In one cycle of operation, the body is thrust longitudinally along a first stroke length while a first gripper is actuated and a second gripper is retracted. During the first stroke length, the second gripper moves along the tractor body in a reset motion. Then, the second gripper is actuated and the first gripper is subsequently retracted. The body is thrust longitudinally along a second stroke length. During the second stroke length, the first gripper moves along the tractor body in a reset motion. The first gripper is then actuated and the second gripper subsequently retracted. The cycle then repeats. Alternatively, a tractor may be equipped with only a single gripper, for example for specialized applications of well intervention, such as movement of sliding sleeves or perforation equipment.

Grippers can be designed to be powered by fluid, such as drilling mud in an open tractor system or hydraulic fluid in a closed tractor system. Typically, a gripper assembly has an actuation fluid chamber that receives pressurized fluid to cause the gripper to move to its actuated position. The gripper assembly may also have a retraction fluid chamber that receives pressurized fluid to cause the gripper to move to its retracted position. Alternatively, the gripper assembly may have a mechanical retraction element, such as a coil spring or leaf spring, which biases the gripper back to its retracted position when the pressurized fluid is discharged. Motor-operated or hydraulically controlled valves in the tractor body can control the delivery of fluid to the various chambers of the gripper assembly.

The original design of the Western Well Tool Puller-Thruster tractor incorporated the use of an inflatable reinforced rubber packer (i.e., "Packerfoot") as a means of anchoring the tool in the well bore. This original gripper concept was improved with various types of reinforcement in U.S. Pat. No. 6,431,291, entitled "Packerfoot Having Reduced Likelihood of Bladder Delamination." This patent is incorporated herein by reference in its entirety. This concept developed a "gripper" with an expansion of the diameter of approximately 1 inch. This design was susceptible to premature failure of the fiber terminations, subsequent delamination and pressure boundary failure.

The second "gripper" concept was the Roller Toe Gripper (U.S. Pat. Nos. 6,464,003 and 6,640,894). These patents are incorporated herein by reference in their entirities. The current embodiment of this gripper works exceedingly well, however in one current embodiment, there are limits to the extent of diametrical expansion, thus limiting the well bore variations compatible with the "gripper" anchoring. Historically, the average diametrical expansion has averaged approximately 2 inches. Several advantages of the RTG compared to the bladder concept were enhanced service life, reliability and "free expansion" capabilities. Free Expansion is a condition when the gripper is completely inflated but does not have a wall to anchor against. This condition is usually only applicable in non-cased or "open-hole" bores. The RTG concept used a ramp and roller combination to radially expand a leaf spring like "toe" to anchor the tractor to the casing. The radial expansion could be fixed with mechanical stops, thereby reducing the risk of overstressing due to free expansion.

Additionally, the prior art includes a variety of different types of grippers for tractors. One type of gripper comprises a plurality of frictional elements, such as metallic friction pads, blocks, or plates, which are disposed about the circumference of the tractor body. The frictional elements are forced radially outward against the inner surface of a borehole under the force of fluid pressure. However, many of these gripper designs are either too large to fit within the small dimensions of a borehole or have limited radial expansion capabilities. Also, the size of these grippers often cause a large pressure drop in the flow-by fluid, i.e., the fluid returning from the drill bit up through the annulus between the tractor and the borehole. The pressure drop makes it harder to force the returning fluid up to the surface. Also, the pressure drop may cause drill cuttings to drop out of the main fluid path and clog up the annulus.

Another type of gripper comprises a bladder that is inflated by fluid to bear against the borehole surface. While inflatable bladders provide good conformance to the possibly irregular dimensions of a borehole, they do not provide very good torsional resistance. In other words, bladders tend to permit a certain degree of undesirable twisting or rotation of the tractor body, which may confuse the tractor's position sensors. Additionally, some bladder configurations have durability issues as the bladder material may wear and degrade with repeated usage cycles. Also, some bladder configurations may substantially impede the flow-by of fluid and drill cuttings returning up through the annulus to the surface.

Yet another type of gripper comprises a combination of bladders and flexible beams oriented generally parallel to the tractor body on the radial exterior of the bladders. The ends of the beams are maintained at a constant radial position near the surface of the tractor body, and may be permitted to slide longitudinally. Inflation of the bladders causes the beams to flex outwardly and contact the borehole wall. This design effectively separates the loads associated with radial expansion and torque. The bladders provide the loads for radial expansion and gripping onto the borehole wall, and the beams resist twisting or rotation of the tractor body. While this design represents a significant advancement over previous designs, the bladders provide limited radial expansion loads. As a result, the design is less effective in certain environments. Also, this design impedes to some extent the flow of fluid and drill cuttings upward through the annulus.

Some types of grippers have gripping elements that are actuated or retracted by causing different surfaces of the gripper assembly to slide against each other. Moving the gripper between its actuated and retracted positions involves substantial sliding friction between these sliding surfaces. The sliding friction is proportional to the normal forces between the sliding surfaces. A major disadvantage of these grippers is that the sliding friction can significantly impede their operation, especially if the normal forces between the sliding surfaces are large. The sliding friction may limit the extent of radial displacement of the gripping elements as well as the amount of radial gripping force that is applied to the inner surface of a borehole. Thus, it may be difficult to transmit larger loads to the passage, as may be required for certain operations, such as drilling. Another disadvantage of these grippers is that drilling fluid, drill cuttings, and other particles can get caught between and damage the sliding surfaces as they slide against one another. Also, such intermediate particles can add to the sliding friction and further impede actuation and retraction of the gripper.

SUMMARY OF THE INVENTION

In one embodiment, the present application relates to a gripper for use in a downhole tool such as a tractor that overcomes the shortcomings of the prior art noted above. In some embodiments, the gripper can be configured to provide a desired expansion force over a wide range of expansion diameters. Moreover, the gripper can be highly reliable and durable in operation.

In some embodiments, a gripper assembly for at least temporarily anchoring within a passage is disclosed. The gripper assembly has an actuated position in which said gripper assembly substantially prevents movement between said gripper assembly and an inner surface of said passage, and a retracted position in which said gripper assembly permits substantially free relative movement between said gripper assembly and said inner surface of said passage. The gripper assembly comprises a gripper and an interface section. The gripper defines an interface portion and a gripping surface configured to contact the inner surface of the passage. The interface section is pivotably mounted to a first pivot and a second pivot spaced from said first pivot. One of said interface portion and said interface section comprises a roller. The other of said interface portion and said interface segment defines a rolling surface against which said roller moves. One of said first pivot and said second pivot is capable of moving radially while said roller moves against said rolling surface.

In some embodiments, a gripper assembly for anchoring a tool within a passage and for assisting movement of said tool within said passage is disclosed. The gripper assembly is movable along an elongated shaft of said tool. The gripper assembly has an actuated position in which said gripper assembly substantially prevents movement between said gripper assembly and an inner surface of said passage and a retracted position in which said gripper assembly permits substantially free relative movement between said gripper assembly and said inner surface of said passage. The gripper assembly comprises an actuator, an expandable assembly, a toe, and a roller mechanism. The actuator is configured to selectively move the gripper assembly between the actuated position and the retracted position. The expandable assembly comprises a plurality of segments pivotally connected in series. The expandable assembly is coupled to the actuator such that the expandable assembly is selectively moveable between a retracted position in which a longitudinal axis of the expandable assembly is substantially parallel with the elongated shaft and an expanded position in which the segments of the expandable assembly are buckled radially outward with respect to the elongated shaft. The toe has a first end, a second end, and a central area. The first and second ends are pivotally coupled to the elongated shaft such that they maintain an at least substantially constant radial position with respect to a longitudinal axis of the elongated shaft. The central area is radially expandable with respect to the elongated shaft such that an expanded position of the toe corresponds to the actuated position of the gripper assembly and a retracted position of the toe corresponds to the retracted position of the gripper assembly. The roller mechanism is rotatably coupled to an inner surface of the central area of the toe. The roller mechanism is configured to interface with an outer surface of a segment of the expandable assembly such that as the expandable assembly is buckled by the actuator, the roller mechanism is advanced up the segment and the toe is expanded.

In some embodiments, a method of at least temporarily anchoring a tool within a passage is disclosed. The method may be achieved through generation of a radial expansion force by a gripper of the tool. The method comprises providing a tool, and generating radial expansion force. The step of providing a tool comprises providing a tool having a gripper comprising a radially expandable toe having a roller mechanism positioned on the radially inward side of the toe and an expandable assembly comprising a plurality of segments pivotally coupled in series and positioned radially inward of the toe. The expandable assembly is configured to radially expand the toe by interfacing with the roller mechanism. Generating radial expansion force comprises generating radial expansion force at the toe and comprises: advancing the roller mechanism on the toe along an outer surface of a first segment of the expandable assembly; and buckling the expandable assembly such that one end of the first segment is moved radially outward.

In some embodiments, a method of at least temporarily anchoring a tool within a passage is disclosed. The method is achieved through generation of a radial expansion force by a gripper of the tool and comprises providing a tool, generating a radial expansion force over a first expansion range, generating radial expansion force over a second expansion, generating radial expansion force over a third expansion range. Providing a tool comprises providing a tool having a gripper comprising a radially expandable toe and a link assembly positioned radially inward of the toe and configured to radially expand the toe. Generating radial expansion force over a first expansion range can be by advancing a roller mechanism on the toe of the gripper up a ramp coupled to a link of the link assembly. Generating radial expansion force over a second expansion range can be by advancing the roller mechanism over an outer surface of a link of the link assembly and by buckling of the link assembly radially outward with respect to the tool. Generating radial expansion force over a third expansion range can be by advancing the roller mechanism over an outer surface of the link of the link assembly.

DETAILED DESCRIPTION OF THE PREFERRED EMBODIMENT

In certain embodiments, the Expandable Ramp Gripper or ERG incorporates the use of a plurality of interconnected links to produce a dual radial force mechanism. Initially, the links can desirably provide a combination of a toggle mechanism and roller/ramp mechanism to produce two sources of radial force. As the centerline of the two links approaches a predetermined deployment angle, such as, for example, approximately 90°, the toggle mechanism no longer contributes and the roller/ramp mechanism provides the sole source of radial force.

The ERG gripper, as illustrated in FIGS. 1-9, can be configured to function by means of an expandable assembly applying a radial expansion force to an overlying toe assembly to expand the toe assembly. The gripper can be a stand alone subassembly that is desirably universally adaptable to all applicable tractor designs. The ERG gripper can be positioned in a passage and operated in either axial orientation with respect to the uphole and downhole directions of a particular passage. However, as further discussed below with respect to the Figures herein, it can be desirable to orient the ERG such that the mandrel cap 138 (FIG. 1) is at the downhole end of the ERG and the cylinder cap 106 (FIG. 1) is at the uphole end. Thus, the discussion herein assumes the ERG is positioned in a passage such that the mandrel cap 106 is at the downhole end of the ERG.

Figure 1:
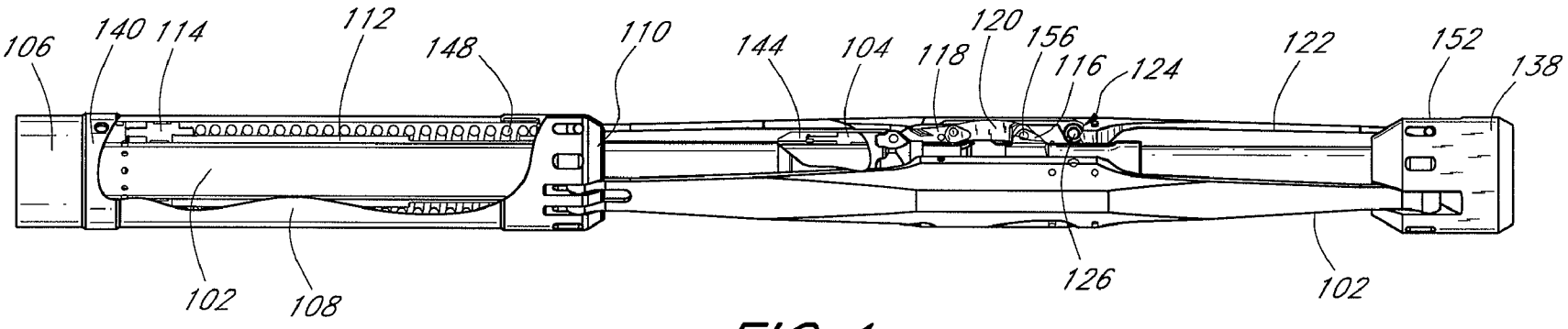
FIG. 1 is a cut away side view of one embodiment of gripper assembly.

As illustrated in FIG. 1, the gripper comprises an actuator and a gripper assembly. The actuator is described in more detail in FIG. 2. In the illustrated embodiments, the actuator comprises a spring returned, single acting hydraulic piston-cylinder assembly. This hydraulic actuator can provide a substantially constant axial force to the expandable assembly that the expandable assembly can translate into radial force. In other embodiments, other mechanical, hydraulic, or electric actuators can be coupled to the gripper assembly mechanism to expand and retract the gripper. The radial force generated by the expandable assembly deflects the toes outward until either the wellbore or casing is engaged or the radial deflection ceases due to mechanical stops. As with previous grippers, the ERG may allow axial translation of a tractor shaft while the gripper is engaged.

The ERG gripper can be broken down into several sub assemblies for ease of description. For example, as discussed herein, the ERG is categorized into cylinder assembly, expandable assembly, and toe assembly. While each ERG gripper subassembly is described herein with respect to the illustrated embodiments as comprising various structural components, it is contemplated that in alternate embodiments, the structural components could form part of other sub assemblies. For example, while as further discussed below and illustrated herein, the toe assembly can include a buckling pin to interface with a flange on the expandable assembly, in other embodiments, the toe assembly can include a flange and a pin can be located on the expandable assembly.

Actuator or Cylinder Assembly

As noted above, FIG. 2 illustrates an actuator or cylinder assembly for generating axial force to selectively expand and retract the ERG gripper. In the illustrated embodiment, the cylinder assembly is a hydraulic spring returned single-action piston and cylinder actuator comprising a cylinder cap 106, cylinder 108, toe support 110, piston 114, piston rod 112, spring 148, spring guide 146, mandrel 102, wear ring 140, and associated seals and wear guides. The mandrel 102 can provide a fluid channel from ports in the shaft to the piston area of the cylinder assembly independent of the axial position of the ERG relative to the shaft ports. Therefore, the actuator can be supplied with pressurized hydraulic fluid to generate force while the actuator is axially slid with respect to the downhole tool. When an ERG is integrated into a downhole tractor assembly, the mandrel 102 can also form an integral part of the main load path on the aft shaft assembly.

Figure 2:
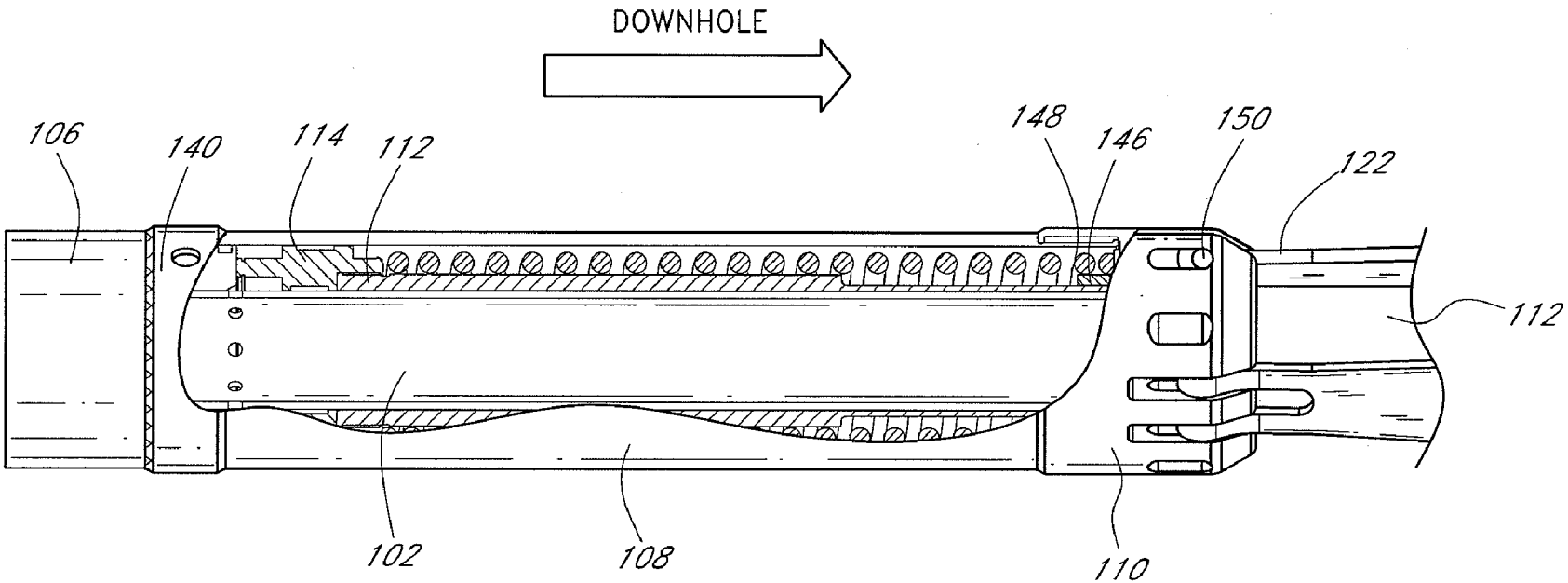
FIG. 2 is a cut away side view of an actuator of the gripper assembly of FIG. 1.

With reference to FIG. 2, the cylinder cap 106, cylinder 108 and toe support 110 define a structural cylinder housing of the cylinder assembly. The cylinder cap 106 and toe support 110 can be attached to the cylinder 108 in a multitude of ways including outside diameter (OD) threads, inside diameter (ID) threads, pins, or any combination thereof. The cylinder cap 106 can desirably provide a seal between the piston area and annulus. In certain embodiments, the cylinder cap 106 can also rigidly connect the ERG to the shaft cylinder assembly to form a portion of the tractor.

In the embodiment illustrated in FIG. 1, the toe support 110 acts as an attachment point for toe assemblies (and functions as the cap on the spring side of the cylinder assembly). As illustrated in FIG. 2, the toe support 110 in combination with the spring guide 146 can provide a mechanical stop for the piston 114 and piston rod 112 to prevent over travel. In other embodiments, other mechanical stops can be provided to limit travel of the piston 114 and piston rod 112.

Figure 3:
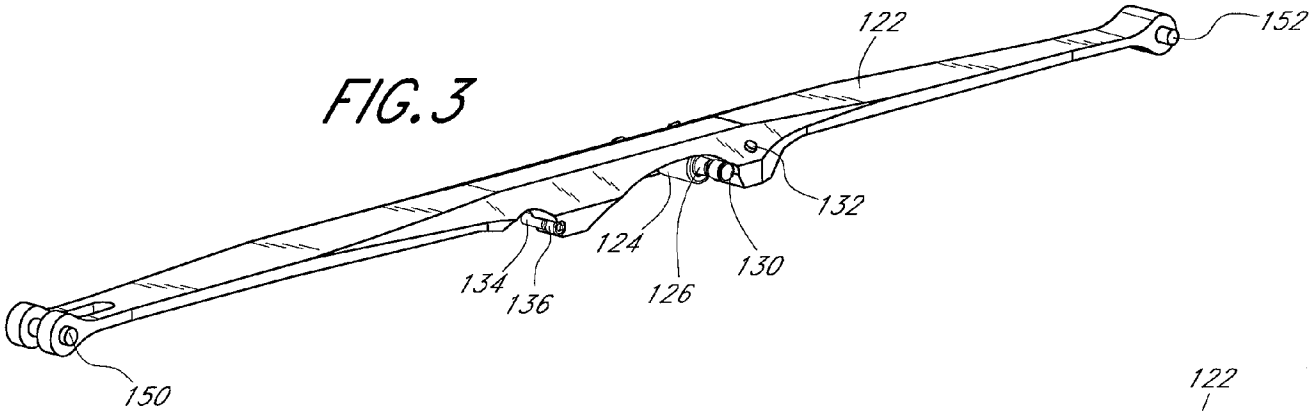
FIG. 3 is a cut away perspective view of a toe assembly of the gripper assembly of FIG. 1.
Figure 3A:
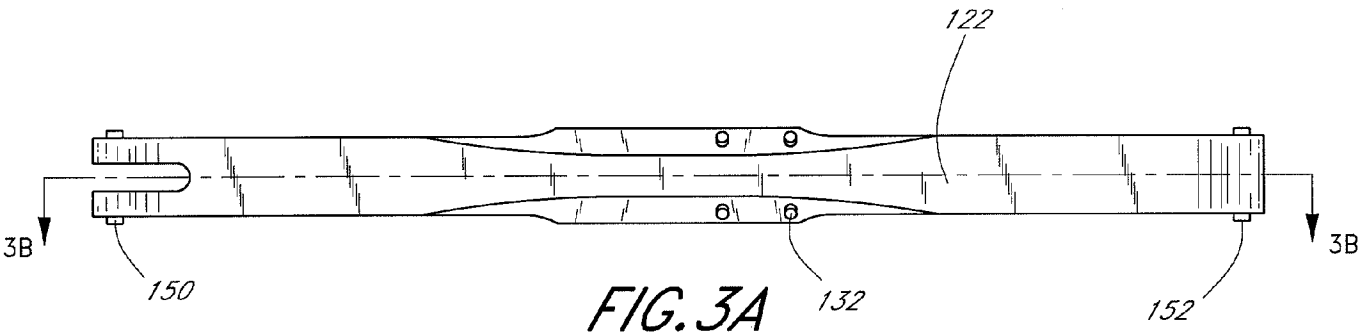
FIG. 3A is a top view of the toe assembly of FIG. 3.
Figure 3B:
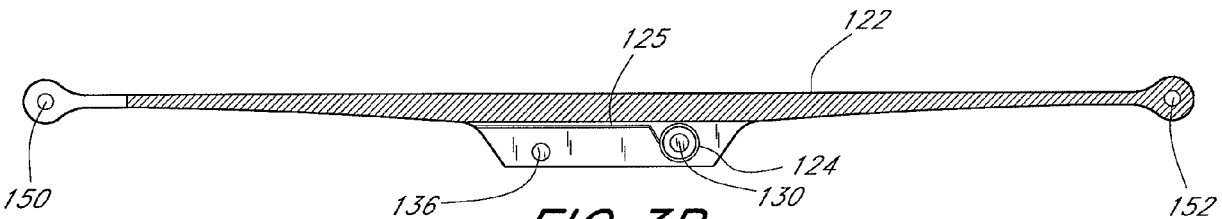
FIG. 3B is a cut away side view of the toe assembly of FIG. 3 taken along line 3B-3B.

As illustrated in FIG. 2, the piston 114 desirably includes both inner diameter and outer diameter seals to prevent hydraulic fluid from escaping between the piston and the mandrel 102 (on the inner side) and between the piston 114 and the cylinder 108 (on the outer side). The piston 114 is desirably firmly attached to the piston rod 112 such that movement of the piston 114 moves the piston rod 112 a like amount. The piston 114 axially translates between the mandrel 102 and cylinder 108 on the inner diameter and outer diameter, respectively. In the illustrated embodiment, the piston 114 travels in the downhole direction (in the direction of the arrow in FIG. 2) during ERG expansion. In some embodiments, movement of the piston 114 (and, thus, activation of the gripper) can be controlled by activation from fluid pressure from a tractor control assembly. When hydraulic fluid the piston area is vented to annulus (outside the tractor), the piston 114 can be returned to the uphole position, by the spring 148, thereby allowing the gripper to retract Toe Assembly With reference to FIG. 1, the gripper assembly desirably includes three toe or engagement assemblies substantially equally angularly placed around the mandrel 102. Advantageously, a gripper assembly having three toe assemblies can apply radial expansion force to grip a passage having a non-uniform, or out-of-round geometry. In other embodiments, the gripper assembly can include more or fewer toe assemblies. As illustrated in FIGS. 3, 3A, and 3B, a toe assembly generally comprises an engagement portion or toe 122 and an expandable assembly interaction mechanism. The toe 122 can comprise a first end configured to be coupled to toe support 110 (FIG. 1) with one or more pins 150, a second end configured to be coupled to the mandrel cap 138 with one or more pins 152, and a central area between the first and second ends in which the expandable assembly interaction mechanism is positioned.

As illustrated in FIG. 1, the first and second ends of the toe 122 can be coupled to the gripper assembly in pin-to-slot connections such that the ends of the toe 122 can translate axially with respect to the mandrel cap 138 and toe support 110 to allow the central area of the toe 122 to be radially expanded with respect to the mandrel 102. In a collapsed configuration, the toe 122 can axially move in the slots of the mandrel. This movement allows the toe 122 to shift until one of the toe eyes takes all exterior loading in tension. In the expanded condition, the slots allow for axial shortening of the toe 122 during deflection of the central area. However, with the illustrated pin-to-slot connection, the first and second ends of the toe 122 are substantially radially fixed with respect to the mandrel 102. In other embodiments, different connections can be used to couple the toe 122 to the gripper assembly. For example, in one embodiment, one end of the toe 122 can be coupled in a pin-to-socket type connection such that its movement is restrained both radially and axially, while the other end of the toe 122 can be coupled in a pin-to-slot type connection as illustrated.

As illustrated in FIGS. 1, 2, and 3A, one end of the toe 122 can be bifurcated such that it can be coupled to the gripper assembly by two pinned axle connections rather than a single pinned axle. A bifurcated end with two relatively short pinned axles can better withstand high loading encountered where the toe 122 is coupled to the gripper assembly than a non-bifurcated end with a single relatively long pinned axle. Thus, it can be desirable that the uphole end, which is likely to encounter relatively high tension forces during operation of the ERG be bifurcated. In the illustrated embodiment, the first end of the toe 122, configured to be positioned at the uphole end of the ERG, is bifurcated. The first end of the toe 122 can be coupled to the toe support 110 with two relatively short pins 150. In other embodiments, both ends of the toe 122 can be bifurcated. In still other embodiments, toes having one or both ends tri-furcated (that is, a toe end has two slots and three toe eyes to support connection by three axles). Toes having tri-furcated ends can exhibit reduced contact stress at the edge of the toe, but tri-furcated ends can have increased space requirements.

FIGS. 3 and 3B illustrate cut away views of the toe 122 with portions removed to illustrate the expandable assembly interaction mechanism in the central area. In the embodiment illustrated in FIGS. 3, 3A, and 3B, the expandable assembly interaction mechanism comprises a roller 124 rotatably mounted to the toe 122 on an axle 126. The axle 126 can pass through an axis of rotation of the roller 124 and couple the roller 124 in a recess or slot on an inner surface of the central area of the toe 122. The roller 124 can be positioned such that it interfaces with the expandable assembly to radially expand the central area of the toe 122 with respect to the mandrel 102. While a roller as illustrated herein can be a relatively efficient mechanism to transfer expansion forces from the expandable assembly to the toe 122, in other embodiments, the expandable assembly interaction mechanism can comprise other mechanisms such as multiple rollers or a relatively low friction skid plate. As further discussed below, the toe 122 can also include a buckling mechanism such as the illustrated buckling pin 134, also positioned in a recess 136 or slot on an inner surface of the central area of the toe 122.

With reference to FIG. 3A, the radially outer surface of the central area of the toe 122 can include gripping elements 132. The gripping elements 132 can comprise metallic inserts configured to grip a passage, such as by surface roughening or texturing to present a relatively high friction outer surface to provide a positive lock between the toe and casing/formation to effectively transfer load. The gripping elements 132 can desirably be pressed into the outside of the toe 12. Alternatively, the gripping elements 132 can be connected to the toe 122 by welding, adhering, or securing with fasteners.

Expandable Assembly

Figure 4:
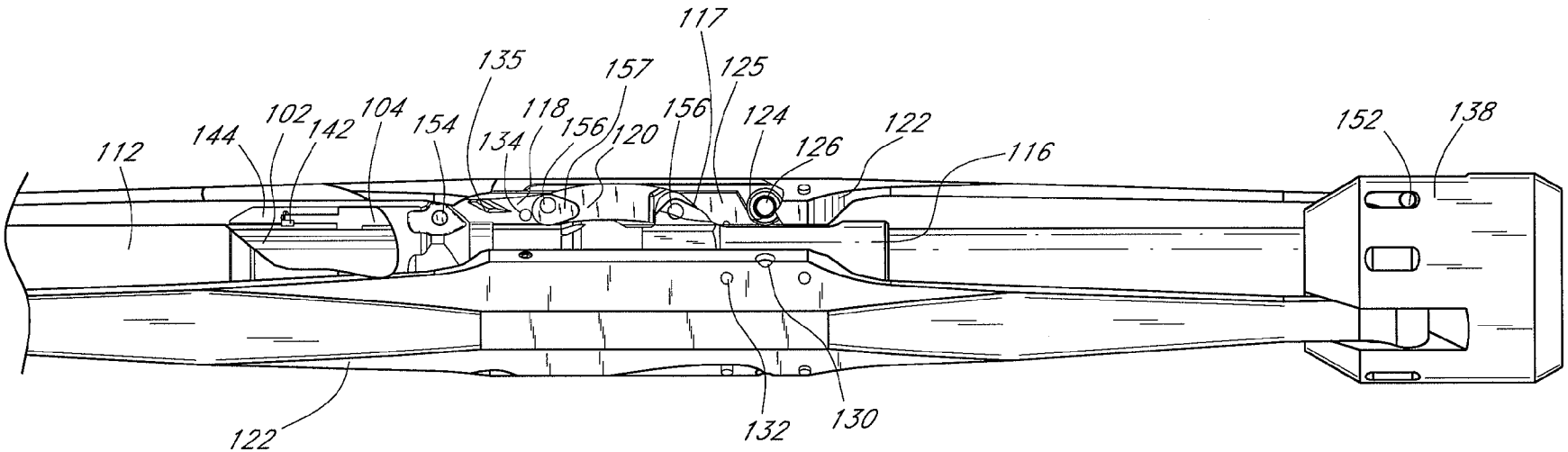
FIG. 4 is a cut away side view of the expandable assembly of the gripper assembly of FIG. 1.

With reference to FIGS. 4-9 an expandable assembly is illustrated underlying the toe assembly. In the illustrated embodiment, the expandable assembly comprises a linkage assembly having a plurality of member segment links 118, 120 connected serially end to end. The member segment links 118, 120 of the expandable assembly are moveable between a retracted position in which a longitudinal axis of the link assembly is substantially parallel with the elongated shaft and an expanded position in which the link assembly is buckled radially outward with respect to the elongated shaft. Desirably, the expandable assembly comprises two segments pivotally connected to each other end-to-end. As depicted in FIG. 4, the expandable assembly comprises a first link 118 and a second link 120. In the illustrated embodiment, the first link 118 is rotatably coupled to the second link 120 with a pin 156. In the illustrated embodiment, the first link 118 is relatively short in an axial direction relative to the second link 120. Advantageously, this linkage geometry contributes to the ERG expansion cycle properties of high force exertion over a relatively large expansion range of the gripper assembly. However, in other embodiments, the relative axial lengths of the links 118, 120 can be varied to achieve other desired expansion characteristics.

With reference to FIGS. 1 and 4, the expandable assembly is operatively coupled to the cylinder assembly to facilitate the transfer of axial motion generated by the cylinder assembly into radial expansion of the toe assembly. As illustrated, an end of the first link 118 is rotatably coupled to an operating sleeve 104 with a pin 154 such as a tight fit pin. This pinned connection axially positions the first link 118 relative to the toe assembly when the ERG is in a collapsed position. The operating sleeve 104 is coupled to a protruding end of the piston rod 112. As noted above, the first link 118 can be pinned to the second link 120 with a pin 156 near one end of the second link 120. The opposite end of the second link 120 can be pinned to a sliding sleeve 116, which can axially translate relative to the mandrel 102 (FIG. 1). In the illustrated embodiments, pins 154, 156 form pinned connections in the expandable assembly to tightly control the position of and the motion of the expandable assembly. However, in other embodiments, other connections, such as other rotatable connections, could be used to interconnect the expandable assembly.

Various materials can be chosen for the expandable assembly to meet desired strength and longevity requirements. Certain materials used in the links 118, 120, and the pins 154, 156 can result in premature galling and wear of the links 118, 120, and a reduced assembly longevity. Undesirably, galling of the links 118, 120, can result in increased retention of debris by the expandable assembly and, in some instances, difficulty in retracting the gripper, and difficulty removing the gripper from a passage. In one embodiment, the links 118, 120 of the expandable assembly are comprised of inconel. In some embodiments, the pins 154, 156 can be comprised of copper beryllium. More preferably, the pins 154, 156 can be comprised of tungsten carbide (with cobalt or nickel binder) to provide an increased operational fatigue life and reduced tendency to gall the links 118, 120.

Figure 5:
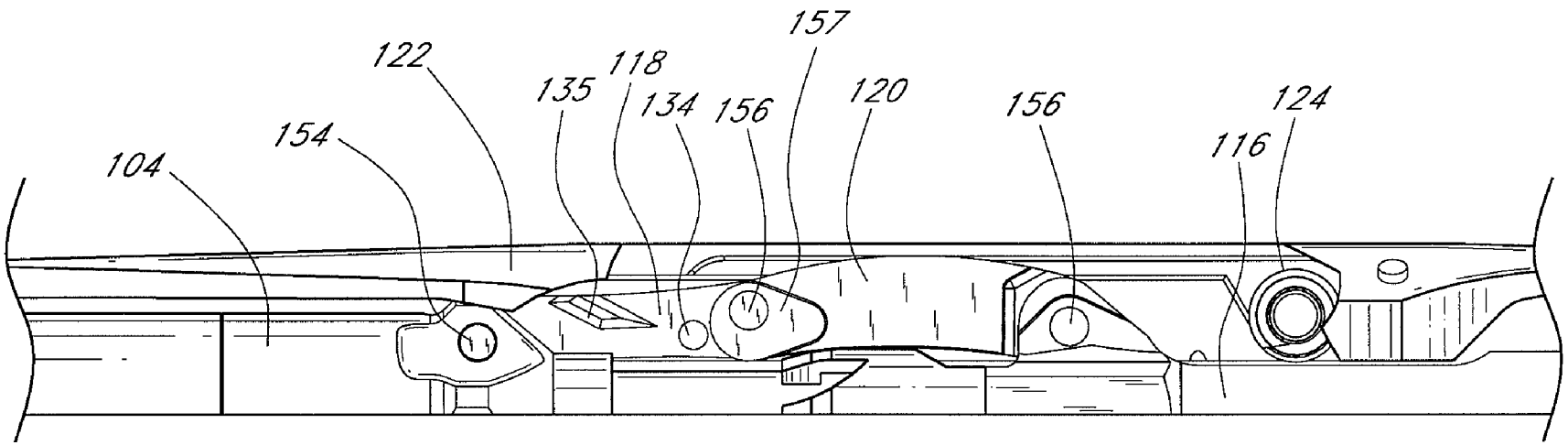
FIG. 5 is a cut away side view of the gripper assembly of FIG. 1 in a collapsed position.

As illustrated in FIGS. 4-5, in a collapsed configuration of the ERG, the expandable assembly underlies the toe assembly such that the roller 124 of the toe assembly is on the downhole side of a ramp 117 formed on the sliding sleeve 116 at the pinned connection of the second link 120 to the sliding sleeve 116. As noted above, the ramp 117 on the sliding sleeve 116 can be said to be a "fixed ramp" as an inclination angle defining the ramp 117 remains constant throughout an expansion cycle of the ERG.

In the illustrated embodiment, substantially the entire expandable assembly underlies the recess in the radially inner side of the central area of the toe 122 in which the roller 124 is positioned. Thus, advantageously, an ERG gripper assembly can be configured such that the expandable assembly and toe assembly comprise a relatively small axial length in comparison to existing gripper assemblies. Thus, when incorporated in a tractor with a given axial length, the ERG can have a relatively long propulsion cylinder assembly allowing for a relatively long piston stroke for axial movement of the tractor. This relatively long piston stroke can facilitate rapid movement of the ERG as fewer piston cycles will be necessary to traverse a given distance.

Operation Description

FIGS. 5-9 illustrate an expansion cycle of the ERG. In FIGS. 5-9 the central area of the toe 122 has been partially cut away to illustrate the interface between a radially inner surface of the toe 122 and the underlying expandable assembly. With reference to FIG. 5, the ERG expansion operation cycle may commence with the ERG in a collapsed position. This collapsed position may be the "as assembled" condition. In the collapsed position, the central area of the toe 122 can have substantially no deflection. The roller 124 is desirably positioned downhole of the ramp 117 of the sliding sleeve 116 and does not contact either the sliding sleeve 116 or the second link 120. With reference to FIG. 2, in the collapsed position, the spring 148 in the cylinder assembly is at substantially full installed height, and the piston 114 is desirably secure against the cylinder cap 106.

First Expansion Stage

Figure 6:
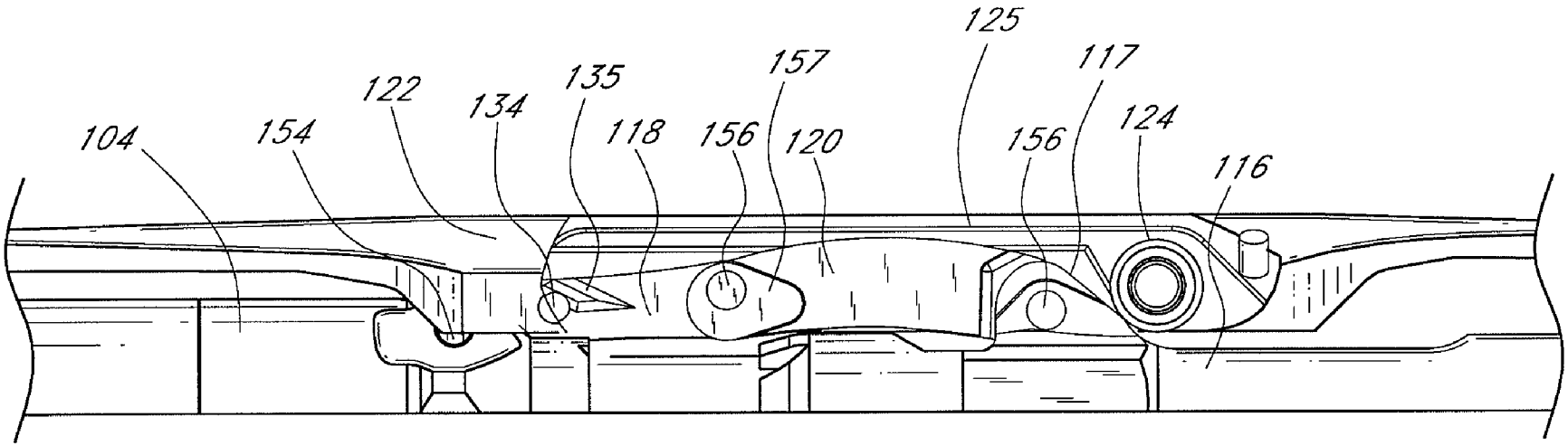
FIG. 6 is a cut away side view of the expandable assembly of the gripper assembly of FIG. 1 in a first stage of expansion.

In FIG. 6, a first stage of expansion is illustrated. In the illustrated embodiment, in the first stage of expansion, axial force generated by the cylinder assembly is transferred to radial expansion force by the interface of the roller 124 on the ramp of the sliding sleeve 116 to initiate expansion of the toe 122. As the piston 114 and piston rod 112 are moved axially downhole, the operating sleeve 104 can axially move the links 118, 120 and sliding sleeve 116 in a downhole direction towards the mandrel cap 138.

During this first expansion stage, the ramp of the sliding sleeve 116 makes contact with the roller 124 on the toe 122, such that the interface of the roller mechanism with the ramp can produce forces with radial and axial components. The produced radial force can drive the central area of the toe 122 radially outward. The produced axial component can react directly against the axial force produced by the piston 114 of the cylinder assembly (FIG. 2) and can cause the expandable assembly to buckle at the rotatable joint coupling the first link 118 and the second link 120.

With reference to FIG. 6, desirably, pins 154, 156 defining the rotatable joints are radially offset relative to one another to help initiate buckling of the first and second links 118, 120. and the buckling pin 134 travels freely between the operating sleeve 104 and the first link 118. Desirably, the rotatable joints are offset by at least approximately 5°, the offset angle defined as the angle between the longitudinal axis of the mandrel 102 and a line extending between the rotational axis of the pin 154 coupling the first link 118 to the operating sleeve 104 and the rotational axis of the pin 156 coupling the second link 120 to the sliding sleeve 116. In other embodiments, other angular offsets sufficient to induce buckling of the expandable assembly can be used.

With reference to FIG. 6, as the links 118, 120 buckle with respect to a longitudinal axis of the mandrel 102 (FIG. 1), they produce both a radial and horizontal force component. The radial force component can be tangentially applied to the portion of the radially inner surface of the central area of the toe 122 defining a groove or track 125. The expandable assembly can be configured such that a boss 157 on the second link 122 near the rotatable joint near the first and second links 118, 120 transmits force to the toe 122 at the track 125. As the ERG expansion continues, the piston 114 continues to move downhole, thus propagating the buckling of the links 118, 120. An expansion angle formed between the first link 118 centerline and a centerline of the mandrel 102 (FIG. 2) increases with the increased buckling. As this expansion angle increases, the radial load developed by the expandable assembly increases while the axial load transferred to the roller/ramp mechanism decreases only because of friction. As the central area of the toe 122 continues to expand radially, the roller 124 can eventually reach the end of the ramp on the sliding sleeve 116 and can start the transition into the secondary stage.

Figure 7:
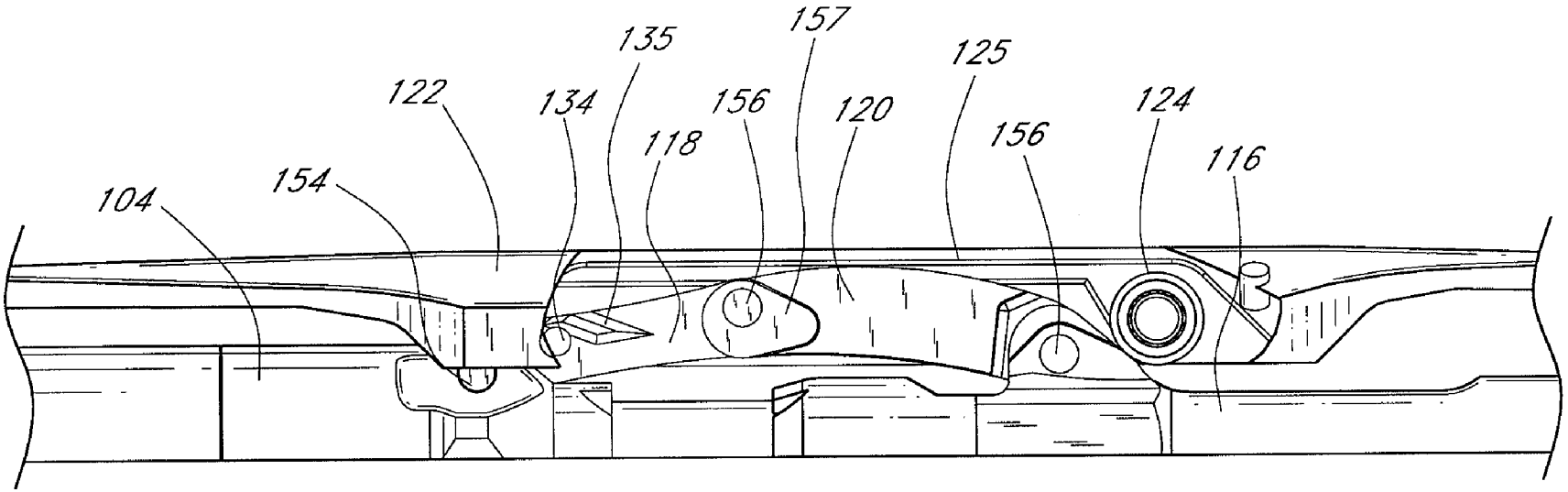
FIG. 7 is a cut away side view of the expandable assembly of the gripper assembly of FIG. 1 in a first stage of expansion with a buckling pin in contact with a directing surface.

With reference to FIG. 7, in some embodiments, the ERG can include a buckling mechanism to facilitate proper buckling of the expansion assembly in case the ERG encounters debris or some other obstacle that may prevent the expandable assembly from buckling during the first stage of expansion. Under normal operation, the buckling pin 134 travels through the ERG expansion cycle substantially without contacting any surfaces. If resistance to buckling increases, possibly due to debris, wear, or contamination, the resistance can overcome the angular offset mechanical advantage of the joints of the links 118, 120. In instances of increased resistance to buckling, a buckling mechanism comprising a buckling pin 134 and an interfacing flange 135 can provide additional radial force to induce instability and buckle the links. If during the first stage of expansion, the links 118, 120 have not started to buckle, radial movement of the toe 122 can force the buckling pin 134 to contact a flange 135 or wing of the first link 118. The flange 135 and buckling pin 134 can be sized and positioned to buckle the first link 118 to an expansion angle of about 9° before the buckling pin 134 transitions off of the flange 135. Although the buckling mechanism is depicted with a certain configuration, it is contemplated that the buckling pin could be relocated to one of the links and the interfacing wing relocated to the toe adjacent the pin, or other structures used to initiate buckling of the links.

Second Expansion Stage

Figure 8:
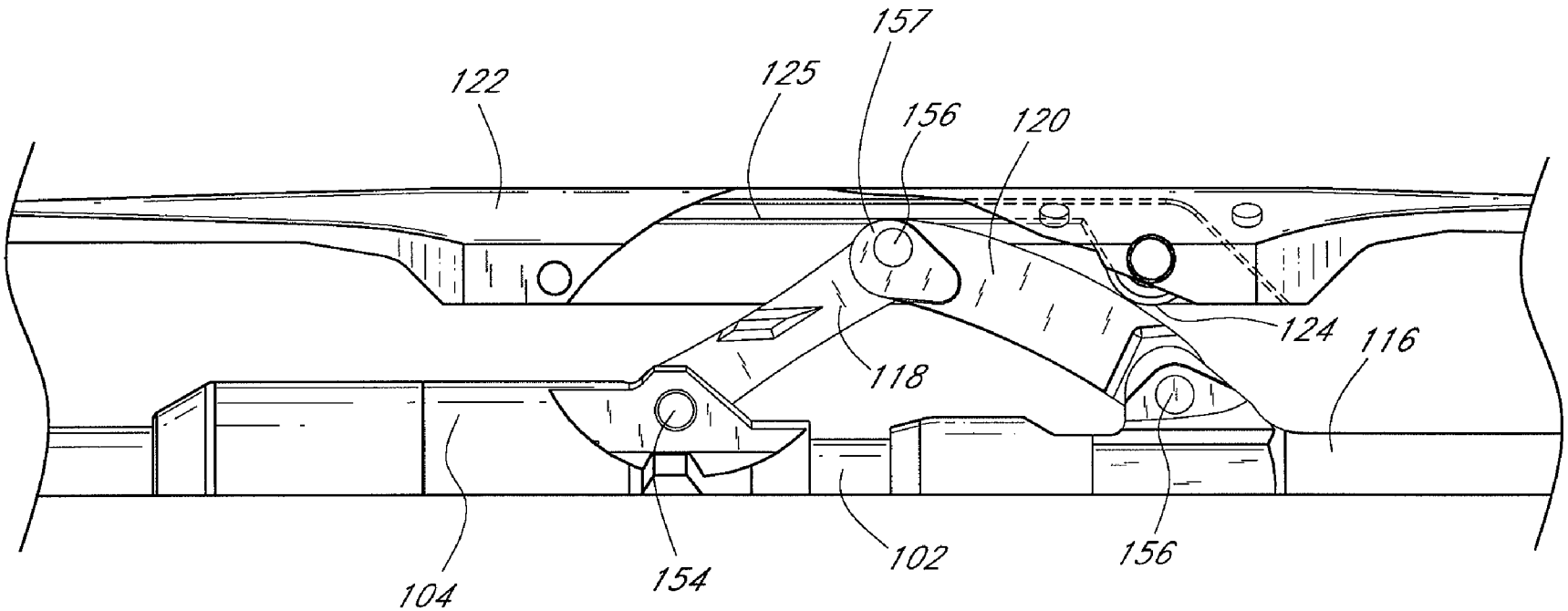
FIG. 8 is a cut away side view of the expandable assembly of the gripper assembly of FIG. 1 in a second stage of expansion.

With reference to FIG. 8, a second stage of gripper expansion commences when the roller 124 transitions from the ramp of the sliding sleeve 116 onto an outer surface of the second link 120. The outer surface of the second link can have an arcuate or cam-shaped profile such that to provide a desired radial force generation by the advancement of the roller along the outer surface of the second link as the expandable assembly continues to buckle. During the second expansion stage, the links 118, 120 can continue to buckle until they reach a maximum predetermined buckling angle defined by the angle between link centerlines.

The load path during the second stage of expansion remains relatively comparable to that of the first stage described above once the expandable assembly has buckled. During the second stage of expansion, radial expansion forces are generated both by the interaction of the roller 124 with the second link 120 and by interaction of the boss 157 on the second link 120 with the track 125 on the toe 122. With the illustrated linkage geometry, the radial force generated by the links 118, 120 as applied to the track 125 of the toe increases through this stage while the radial force generated by the roller 124 interacting with the second link 120 can vary depending on the tangent angle between them. This tangent angle can vary based on the expansion angle of the second link 120 relative to the longitudinal axis of the mandrel 102 (FIG. 2), and the profile of the outer surface of the second link 120.

The surface profile of the second link 120, in contact with the roller 124, can be configured to provide a desired force distribution over the second expansion stage. This surface shaping allows the link 120 and roller 124 system to produce fairly consistent radial force within a desired expansion force range throughout the expansion range of the toe 122. Additionally, the links 118, 120 continue to provide a secondary radial force through the second stage of the expansion. In the initial stage, the fixed ramp defined by the sliding sleeve 116 had a substantially constant angle (and thus provided substantially constant radial load). In light of the variance in radial force produced during the second stage of engagement, desirably, the surface of the second link 120 is configured so that the mechanism produces a radial force in an acceptable working range over the expansion range of the mechanism.

Third Expansion Stage

Figure 9:
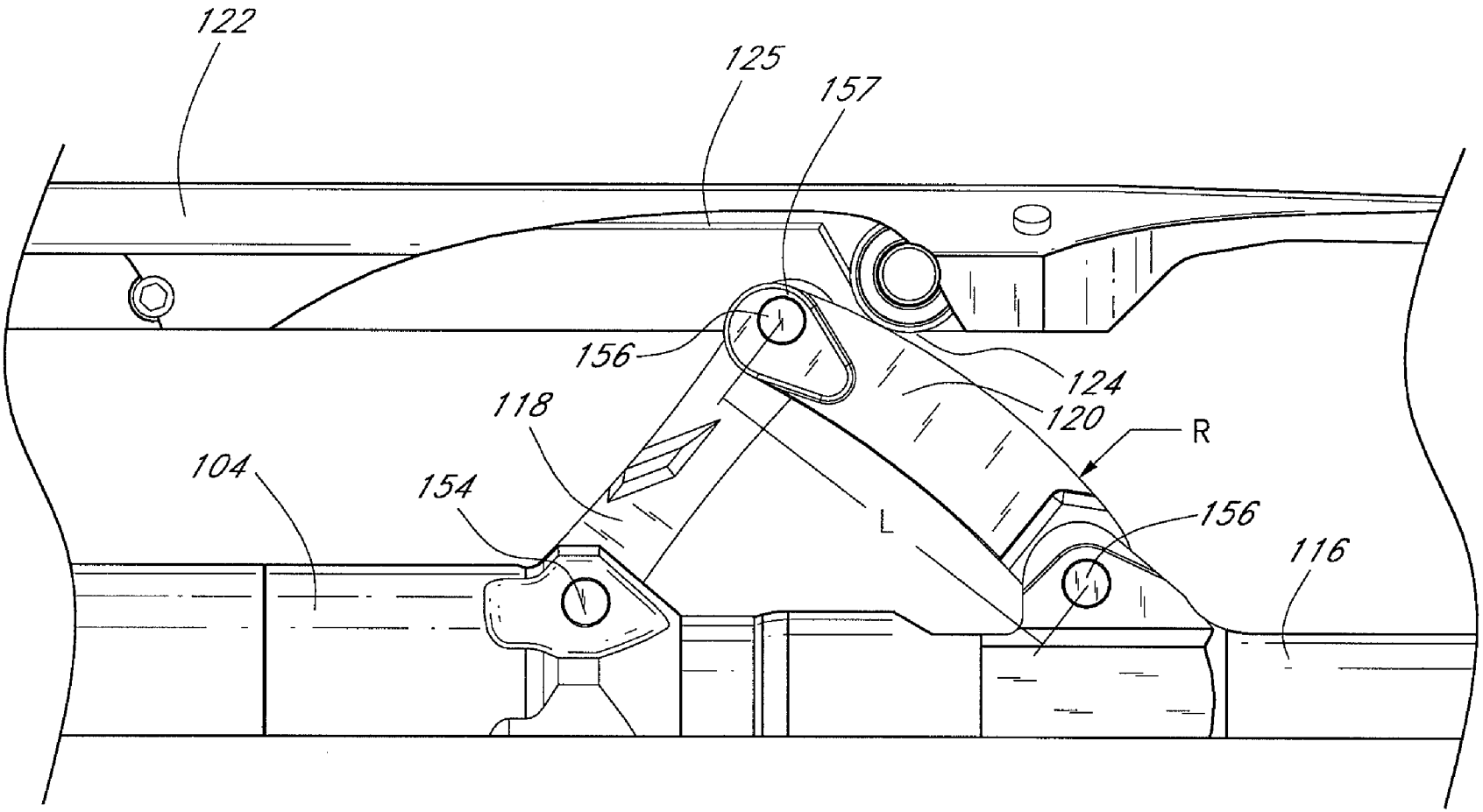
FIG. 9 is a cut away side view of the expandable assembly of the gripper assembly of FIG. 1 in a third stage of expansion.

With reference to FIG. 9, a third stage of expansion of the ERG begins when the first link 118 has risen to a maximum design expansion angle. In the illustrated embodiment, this maximum expansion angle is reached when the operating sleeve 104 contacts the sliding sleeve 116 stopping the links 118, 120 from expanding further. Once maximum buckling of the links 118, 120 has been reached, as the piston 114 continues moving axially downhole, the boss 157 of the second link 120 loses contact with the track 125 on underside of the toe 122. Thus, in the third expansion stage, interface of the second link 120 with the roller mechanism 124 provides the sole radial expansion force to the toe 122. As with the second expansion stage described above, the outer profile of the second link 120 determines the tangent angle and the resultant radial force.

Once expansion of the ERG is complete, it can be desirable to return the gripper to a retracted configuration, such as, for example to retract a tractor from a passage. It is desirable when removing the gripper from a tractor that the gripper assembly be in the retracted position to reduce the risk that the tractor can become stuck downhole. Thus, the actuator and expandable assembly of the ERG can desirably be configured to provide a failsafe to bias the gripper assembly into the retracted position. As noted above, upon release of hydraulic fluid the spring return in the actuator returns the piston. Thus, the spring returned actuator in the illustrated embodiment of the ERG advantageously provides a failsafe to return the gripper to the retracted configuration. The spring return in the actuator acts on both the operating sleeve 104 and the sliding sleeve 116 to return the expandable assembly into the retracted position. This spring-biased return action on two sides of the expandable assembly returns the expandable assembly to the retracted position. Specifically, the toes 122 will collapse as the expandable assembly collapses and the roller 124 moves down the second link 120 onto the ramp of the sliding sleeve 116.

Exemplary Radial Force Curve

Figure 10:
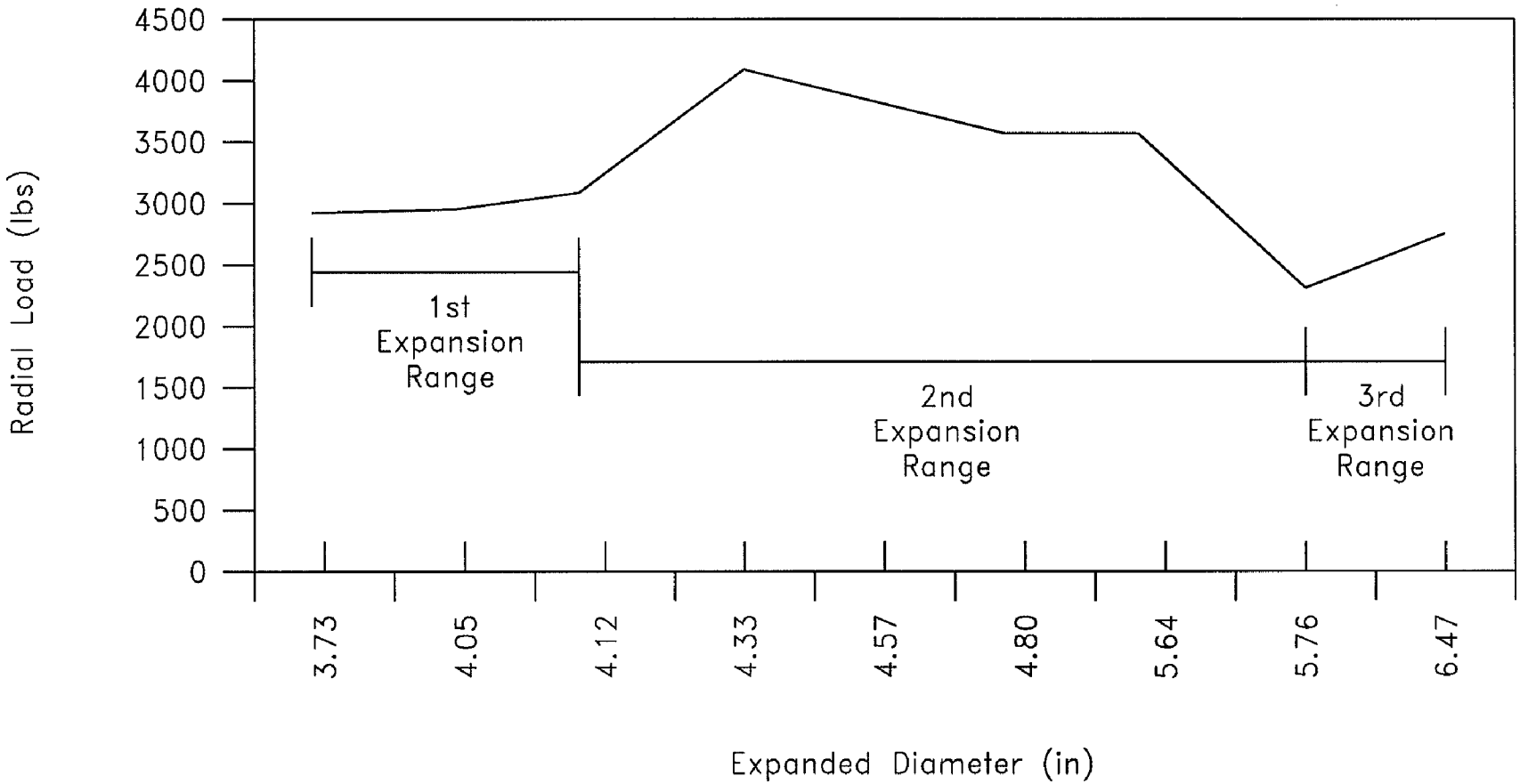
FIG. 10 is an exemplary graph depicting the radial load exerted by the gripper assembly of FIG. 1 versus an expanded diameter of the gripper assembly.

FIG. 10 illustrates an exemplary curve of the generated radial load at various expansion diameters. It is contemplated that while this figure depicts certain loads at certain expansion diameters, in various embodiments, an expandable ramp gripper could be configured to operate over different expansion ranges and generate different radial loads. Therefore, while the general profile of the illustrated curve is related to the link 118, 120 and sliding sleeve 116 ramp geometry, the more specific nature of the curve can be adjusted by the component design. As illustrated in FIG. 10, for small expansion diameters, the initial segment of the plotted curve, which is nearly linear, is indicative of the first stage of expansion.

With continued reference to FIG. 10, as the slope of the curve changes significantly at approximately 4.12 inches, the operation has entered the second stage. The profile of this second segment of the curve can be varied by geometry on the outer surface of the second link. The outer surface geometry can produce varying radial forces at the roller ramp interface which can be seen in the shape of a similarly plotted curve for different ERG embodiments. However, it is desirable to keep the radial load in a functional range. Desirably, the ERG is configured such that the lower threshold of its functional range is considered to be at least the minimum radial force necessary to react the tractor force. The upper threshold is dictated by the component stresses of the assembly. Varying the arcuate profile of the second link 120 can reduce the radial force generated to keep the component stresses of the assembly within a desired range.

With reference to FIG. 10, as the expansion diameter reaches approximately 5.76 inches, the assembly has entered into the third stage of the expansion process. As discussed above, in the third expansion stage, the boss 157 on the second link 120 has left contact with the track 125 on the toe 122. Thus, radial expansion force is generated solely by the interface of the roller 124 advancing up the second link 120. Thus, the radial force generated during this stage can be manipulated by the configuration of the outer surface of the second link 120.

While FIG. 10 illustrates an exemplary load versus expanded diameter chart, it is recognized that other embodiments of the ERG would exhibit different load versus expansion plots. Furthermore, it is recognized that by differently sizing and configuring the ERG assemblies, the illustrated ranges could have different sizes. For example, while the illustrated embodiment depicts a first expansion range from approximately 3.7 inches to approximately 4.1 inches, in other embodiments, the smaller expanded configuration of the ERG in the first expansion range could be an expanded diameter between approximately 2 inches and 4.5 inches, desirably between 3 inches and 4 inches, and more desirably between 3.5 inches and 4 inches. Likewise, in other embodiments, the larger expansion configuration of the ERG in the first expansion range could be an expanded diameter between approximately 2.4 inches and approximately 5 inches, desirably between 3.4 inches and 4.4 inches, and more desirably between 3.9 inches and 4.4 inches. The span between the smaller expanded and larger expanded configurations of the ERG in first expansion range is largely determined by the size of the fixed ramp 117 on the operating sleeve 116 (see e.g., FIGS. 4 and 5). In some embodiments, the fixed ramp 117 can be sized and configured to allow for a span between the smaller expanded and larger expanded configurations of the first expansion range of between 0.2 inches and 1 inch, desirably between 0.3 inches and 0.7 inch, and more desirably between 0.4 inches and 0.5 inches.

FIG. 10 illustrates a second expansion range from an expanded diameter of approximately 4.1 inches to an expanded diameter of approximately 5.76 inches. In other embodiments, the expanded diameter of the smaller expanded configuration of the ERG in second expansion range can be between approximately 2.4 inches and 5 inches, desirably between 3.4 inches and 4.4 inches, and more desirably between 3.9 inches and 4.4 inches. Likewise in other embodiments, the larger expanded configuration of the ERG in the second expansion range can have an expanded diameter between approximately 3.9 inches and 6.5 inches, desirably between approximately 5.2 inches and 6.2 inches, and more desirably between 5.5 inches and 6 inches. In some embodiments, the span between the smaller expanded diameter and the larger expanded diameter of the second expansion range can be between 0.5 inches and 2.5 inches, desirably between 1 inch 2 inches, and more desirably between 1.5 inches and 1.9 inches.

FIG. 10 illustrates a third expansion range from an expanded diameter of approximately 5.76 inches to an expanded diameter of approximately 6.5 inches. In other embodiments, the expanded diameter of the smaller expanded configuration of the ERG in third expansion range can be between approximately 3.9 inches and 6.5 inches, desirably between approximately 5.2 inches and 6.2 inches, and more desirably between 5.5 inches and 6 inches. Likewise in other embodiments, the larger expanded configuration of the ERG in the third expansion range can have an expanded diameter between approximately 4.2 inches and 8 inches, desirably between approximately 5.5 inches and 7 inches, and more desirably between 6 inches and 7 inches. In some embodiments, the span between the smaller expanded diameter and the larger expanded diameter of the third expansion range can be between 0.2 inches and 2 inches, desirably between 0.5 inch and 1.5 inches, and more desirably between 0.7 inches and 1.2 inches.

FIG. 10 illustrates a span between the smallest expanded diameter and the largest expanded diameter of the ERG of approximately 2.7 inches. In other embodiments, the ERG could have a total expansion diameter range of between approximately 1 inches and 5 inches, desirably between 2 inches and 3.5 inches, and more desirably between 2.5 inches and 3 inches. In some embodiments, the ratio of a (see, FIG. 9) to the total expansion diameter range can be between approximately 0.4:1 and 0.9:1, desirably between 0.6:1 and 0.8:1. Likewise, as noted above, in some embodiments, the profile of the outer surface of the second link 120 can be configured to achieve desired operating characteristics. In some embodiments, the profile of the outer surface of the second link 120 can be a curved, generally arcuate segment having a radius of curvature, R (FIG. 9). In some embodiments, the ratio of the radius of curvature R of the outer surface of the second link 120 to the length, L between axes of rotation defined by pins 156 on the second link 120 can be between approximately 1.5:1 and approximately 4:1, desirably between approximately 1.75:1 and approximately 2.5:1, and more desirably approximately 2:1.

FIG. 10 illustrates a first radial expansion distance defined by a total radial expansion of the first stage of the expansion range of approximately 0.4 inches, a second radial expansion distance defined by a total radial expansion of the second stage of the expansion range of approximately 1.66 inches, and a third radial expansion distance defined by a total radial expansion of the third stage of the expansion range of approximately 0.75 inches. As noted above, in other embodiments, the first, second, and third stages of the expansion ranges can define different total radial expansions than those illustrated in FIG. 10, thus defining different first, second, and third radial expansion distances. Desirably, in some embodiments, a ratio of the first radial expansion distance to the second radial expansion distance is between approximately 1:2 and approximately 1:4. Desirably, in some embodiments, a ratio of the second radial expansion distance to the third radial expansion distance is between approximately 2:1 and 1.5:1.

Although this application discloses certain preferred embodiments and examples, it will be understood by those skilled in the art that the present inventions extend beyond the specifically disclosed embodiments to other alternative embodiments and/or uses of the invention and obvious modifications and equivalents thereof. Further, the various features of these inventions can be used alone, or in combination with other features of these inventions other than as expressly described above. Thus, it is intended that the scope of the present inventions herein disclosed should not be limited by the particular disclosed embodiments described above, but should be determined only by a fair reading of the claims that follow.

What is claimed is:

1. A gripper assembly having an actuated position in which said gripper assembly substantially prevents movement between said gripper assembly and an inner surface of a passage, and a retracted position in which said gripper assembly permits substantially free relative movement between said gripper assembly and said inner surface of said passage, said gripper assembly comprising:

an actuator configured to selectively move the gripper assembly between the actuated position and the retracted position;

an expandable assembly comprising a plurality of segments pivotally connected in series, the expandable assembly coupled to the actuator such that the expandable assembly is selectively moveable between a retracted position in which a longitudinal axis of the expandable assembly is substantially parallel with an elongated shaft along which the gripper assembly is moveable and an expanded position in which the segments of the expandable assembly are buckled radially outward with respect to the elongated shaft;

a toe having a first end, a second end, and a central area, the first and second ends being pivotally coupled to the elongated shaft such that the first and second ends maintain an at least substantially constant radial position with respect to a longitudinal axis of the elongated shaft, and the central area being radially expandable with respect to the elongated shaft such that an expanded position of the toe corresponds to the actuated position of the gripper assembly and a retracted position of the toe corresponds to the retracted position of the gripper assembly;

a roller mechanism rotatably coupled to an inner surface of the central area of the toe, the roller mechanism configured to interface with an outer surface of one of the plurality of segments of the expandable assembly such that as the expandable assembly is buckled by the actuator, the roller mechanism is advanced up the one of the plurality of segments and the toe is expanded.

2. The gripper assembly of claim 1, wherein the outer surface of the one of the plurality of segments has a curved profile.

3. The gripper assembly of claim 1, further comprising a ramp pivotally coupled to the outer surface, wherein the roller mechanism moves against said ramp for at least a portion of a movement of the gripper assembly between the retracted position and the actuated position.

4. The gripper assembly of claim 1, wherein at least one of the first end and the second end of the toe is bifurcated such that the bifurcated end is pivotally coupled to the elongated shaft by at least two axles.

5. The gripper assembly of claim 4, wherein in operation the gripper assembly is configured such that the first end of the elongated toe is positioned uphole of the second end relative to the passage and wherein the first end of the elongated toe is bifurcated.

6. The gripper assembly of claim 4, wherein the first end of the elongated toe and the second end of the elongated toe are bifurcated.

7. The gripper assembly of claim 4, wherein at least one of the first end and the second end is trifurcated such that the trifurcated end is pivotally coupled to the elongated shaft by three axles.

8. The gripper assembly of claim 1, wherein the plurality of segments defines a link assembly comprising:

a first link having a first end and a second end, the first end being pivotally coupled to the actuator; and a second link having a first end and a second end, the first end being pivotally coupled to the second end of the first link, and the second end being pivotally and slidably coupled to the elongated shaft; and wherein the second link defines the one of the plurality of segments having the outer surface with which the roller mechanism is configured to interface.

9. The gripper assembly of claim 8, wherein a length of the second link is greater than a length of the first link.

10. The gripper assembly of claim 8, wherein the outer surface of the second link has an arcuate profile.

11. The gripper assembly of claim 10, wherein the actuate profile of the outer surface of the second link has a radius of curvature, wherein the second link has a length from the first end to the second end, and wherein a ratio of the radius of curvature of the actuate profile of the outer surface of the second link to the length of the second link is between approximately 1.75:1 and approximately 2.5:1.

12. The gripper assembly of claim 8, wherein the first end of the first link and the second end of the second link are positioned at an angular offset with respect to each other such that advancement of the first end of the first link along the elongated shaft toward the second end of the second link tends to buckle the link assembly radially outward from the elongated shaft.

13. The gripper assembly of claim 8, further comprising a buckling mechanism configured to buckle the link assembly radially outward from the elongated shaft during expansion of the gripper assembly.

14. The gripper assembly of claim 13, wherein the buckling mechanism comprises a buckling pin positioned on one of the toe and the link assembly, and a flange configured to interface with the buckling pin and positioned on the other of the toe and the link assembly.

15. The gripper assembly of claim 8, wherein at least one of the first link and the second link are comprised of inconel.

16. The gripper assembly of claim 15, wherein the first link is pivotally coupled to the second link with a tungsten carbide pin.

17. The gripper assembly of claim 1, wherein the actuator includes a failsafe to bias the gripper assembly in the retracted position.

18. The gripper assembly of claim 1, wherein the gripper assembly is configured to generate radial force over an expansion range between the retracted position and the actuated position of the gripper assembly and expansion of the gripper assembly comprises:

a first stage in which radial force is generated by the roller mechanism advancing up a ramp coupled to the outer surface of the one of the plurality of segments;

a second stage in which radial force is generated by interaction of the roller mechanism with the outer surface of the one of the plurality of segments and by radial movement of a first end of the one of the plurality of segments with respect to a second end of the one of the plurality of segments; and a third stage in which radial force is generated by interaction of the roller mechanism with the outer surface of the one of the plurality of segments.

19. The gripper assembly of claim 18, wherein the first stage of the expansion range spans from an expanded diameter of approximately 3.7 inches to approximately 4.1 inches.

20. The gripper assembly of claim 18, wherein the second stage of the expansion range spans from an expanded diameter of approximately 4.1 inches to approximately 5.76 inches.

21. The gripper assembly of claim 18, wherein the third stage of the expansion range spans from an expanded diameter of approximately 5.76 inches to approximately 6.5 inches.

22. The gripper assembly of claim 18, wherein a ratio of a first radial expansion distance defined by a total radial expansion of the first stage of the expansion range to a second radial expansion distance defined by a total radial expansion of the second stage of the expansion range is between approximately 1:2 and approximately 1:4.

23. The gripper assembly of claim 18, wherein a ratio of a second radial expansion distance defined by a total radial expansion of the second stage of the expansion range to a third radial expansion distance defined by a total radial expansion of the third stage of the expansion range is between approximately 2:1 and approximately 1.5:1.

24. The gripper assembly of claim 23, wherein a ratio of a first radial expansion distance defined by a total radial expansion of the first stage of the expansion range to the second radial expansion distance is between approximately 1:2 and approximately 1:4.

25. A method of at least temporarily achieving anchoring within a passage, the method comprising:

providing a gripper comprising a radially expandable toe having a roller mechanism positioned on the radially inward side of the toe and an expandable assembly comprising a plurality of segments pivotally coupled in series and positioned radially inward of the toe, the expandable assembly configured to radially expand the toe by interfacing with the roller mechanism;

generating radial expansion force at the toe, wherein generating radial expansion force comprises:

advancing the roller mechanism on the toe along an outer surface of a first segment of the expandable assembly;

buckling the expandable assembly such that one end of the first segment is moved radially outward; and engaging the gripper with an inner surface defining the passage to anchor the gripper within the passage.

26. The method of claim 25, wherein the step of buckling the expandable assembly further comprises:

buckling the expandable assembly such that a first end of a second segment of the expandable assembly is moved radially outward, wherein the first end of the second segment is pivotally coupled to the first segment and the second segment is relatively short in an axial direction relative to the first segment.

27. A method of at least temporarily achieving anchoring within a passage, the method comprising:

providing a gripper comprising a radially expandable toe and a link assembly positioned radially inward of the toe and configured to radially expand the toe;

generating radial expansion force over a first expansion range by advancing a roller mechanism on the toe of the gripper up a ramp coupled to a link of the link assembly;

generating radial expansion force over a second expansion range by advancing the roller mechanism over an outer surface of a link of the link assembly and by buckling of the link assembly radially outward respect to the tool;

generating radial expansion force over a third expansion range by advancing the roller mechanism over an outer surface of the link assembly; and engaging the gripper with an inner surface defining the passage to anchor the gripper within the passage.

* * * * *

UNITED STATES PATENT AND TRADEMARK OFFICE

CERTIFICATE OF CORRECTION

PATENT NO. : 7,624,808 B2
APPLICATION NO. : 11/683959
DATED : December 1, 2009
INVENTOR(S) : Phillip W. Mock It is certified that error appears in the above-identified patent and that said Letters Patent is hereby corrected as shown below:

Title page, page 1, (Item 54), (Title), line 1, change "EXPANDABLE RAMP GRIPPER" to --EXPANDABLE RAMP GRIPPER AND METHOD OF USE THEREOF--.

Title Page, page 2, (Item 56), column 1, line 25, under U.S. Patent Documents, below "Horstmeyer et al." insert --4,464,003 10/2002 Bloom et al.--.

Page 1, line 1, change "EXPANDABLE RAMP GRIPPER" to --EXPANDABLE RAMP GRIPPER AND METHOD OF USE THEREOF--.

Column 7, line 55 (approx.), after "retract" insert --.--.

Column 16, line 35, in Claim 11, change "actuate" to --arcuate--.

Column 16, line 39, in Claim 11, change "actuate" to --arcuate--.

Column 18, line 38, in Claim 27, change "respect" to --with respect--.

Signed and Sealed this

Thirteenth Day of July, 2010

David J. Kappos

David J. Kappos
*Director of the United States Patent and Trademark Office*